United States Patent [19]

Sioui

[11] 4,042,347

[45] Aug. 16, 1977

[54] METHOD OF MAKING A RESIN-METAL COMPOSITE GRINDING WHEEL

[75] Inventor: Richard H. Sioui, Holden, Mass.

[73] Assignee: Norton Company, Worcester, Mass.

[21] Appl. No.: 651,792

[22] Filed: Jan. 23, 1976

Related U.S. Application Data

[63] Continuation-in-part of Ser. No. 460,827, April 15, 1974, abandoned.

[51] Int. Cl.[2] ..... C09K 3/14

[52] U.S. Cl. ..... 51/298 R; 51/309 R

[58] Field of Search ..... 51/295, 298, 309

[56] References Cited

U.S. PATENT DOCUMENTS

| | | | |
|---|---|---|---|
| 2,150,886 | 3/1939 | Der Pyl | 51/298 |
| 2,243,105 | 5/1941 | Kuzmick | 51/298 |
| 2,258,774 | 10/1941 | Kuzmick | 51/309 |
| 3,615,302 | 10/1971 | Rowse et al. | 51/298 |
| 3,650,715 | 3/1972 | Brushek et al. | 51/298 |
| 3,664,819 | 5/1972 | Sioui et al. | 51/298 |
| 3,850,590 | 11/1974 | Chalkley | 51/295 |
| 3,868,233 | 2/1975 | Carver et al. | 51/298 |

FOREIGN PATENT DOCUMENTS

| | | | |
|---|---|---|---|
| 1,279,413 | 6/1972 | United Kingdom | 51/295 |

*Primary Examiner*—Donald J. Arnold

*Attorney, Agent, or Firm*—Rufus M. Franklin

[57] ABSTRACT

A metal-resin composite material consisting of a continuous metal matrix and a continuous resin matrix fabricated by hot-pressing a mixture of precursors, the precursors for the metal matrix including an elemental metal having a melting point below 450° C, the metal matrix including an intermetallic compound or alloy having a melting point above 500° C, and the continuous resin matrix being fabricable at a temperature above 250° C. Such composite materials have particular utility as a bonding matrix for premium abrasives such as diamond and boron nitride, to form grinding tools.

6 Claims, No Drawings

METHOD OF MAKING A RESIN-METAL COMPOSITE GRINDING WHEEL

This application is a continuation-in-part of my copending application Ser. No. 460,827, filed Apr. 15, 1974, and now abandoned.

FIELD OF THE INVENTION

This invention relates to a resin-metal composite material for use in fabricating articles for applications where heat stability, heat conductivity, strength, and frictional properties are important. The invention also relates to grinding wheels formed by bonding premium abrasives with the described resin-metal composite material to provide good wear resistance and abrasive retention.

BACKGROUND OF THE INVENTION

British Pat. No. 1,279,413, published June 28, 1972, discloses a process for making abrasive tools, such as grinding wheels, wherein diamond abrasive grits are uniformly dispersed throughout a porous metal matrix, which matrix is then impregnated with a liquid resin, either a thermosetting pre-polymer, or a molten thermoplastic. The liquid resin fills all accessible pores in the metal matrix and is then cured or cooled to a solid condition. Such construction is intended to retain the advantages of the strength and heat conductivity of a metal bond, with the controlled wear properties of a resin bond, particularly in the dry grinding of cemented carbide tools.

U.S. Pat. No. 2,258,774 to Kuzmick, discloses forming diamond wheels by mixing the abrasive with a low melting metal powder composition and a powdered pre-polymer of a thermosetting resin, and molding tools by the application of pressure and heat to the mixture contained in a mold of the desired shape. The metal is selected to have a melting point between 55° C and 327° C, said to be equal to or lower than the temperature developed in the wheel during the grinding operations. As a result, the metal melts during grinding so as to provide a lubricating action.

Although related in structure to the composite matrices of the British patent and of Kuzmick, the composite material of this invention is intended for different grinding applications than either prior art reference and thus differs materially in its physical properties and composition. In particular, it is designed for the wet grinding of cemented carbide although it also gives improved results in dry grinding.

Sears U.S. Pat. No. 3,523,773 discloses a composite glass-resin bond.

SUMMARY OF THE INVENTION

Applicant has discovered that grinding wheels which are particularly effective for the wet grinding of cemented carbide tools can be made by employing diamond grit bonded in a composite matrix of resin and metal so fabricated that all of the powder particles (both resin and metal) have been coalesced into solid continuous, or essentially continuous, phases. Neither the resin nor the metal then is a "filler" in the other, in the sense of a particulate powder, the powders having lost their identity as such in the application of heat and pressure.

In order to achieve the above-described result, it has been found necessary to employ, as the metal part of the system, a combination of metal powders which are fabricable below 450° C, but which, after fabrication, result in an intermetallic compound or an alloy which melts above 500° C. The limit of 450° C is established by the recently available high temperature resins, none of which are sufficiently heat stable to be fabricated at temperatures above 450° C. It will be possible to increase this limit as resins of increasingly greater thermal stability are developed.

Of the possible metal systems, many are eliminated because of expense, toxicity, or chemical instability. The preferred systems require the presence of at least one elemental metal powder in the mix to be fabricated, selected from the group consisting of tin, bismuth, and indium. Tin will form intermetallic compounds (melting above 500° C) with silver, cobalt, copper, iron, manganese, nickel, tantalum, and titanium. Bismuth will form suitable intermetallics with manganese, nickel, and titanium, and indium will form suitable intermetallics with silver, cpper, manganese and nickel. Bonds may also be formed by combinations of the above systems, the only requirement being that the mix to be fabricated include a metal powder which will melt during fabrication and react with other metal present to form a metal phase having a melting point above 500° C.

Under processing conditions employed in this invention, it has been found that the elemental metals do not completely react with each other. Thus, when a copper-tin system is employed, the resulting product will include elemental tin, elemental copper, and the intermetallic $Cu_3Sn$ and a lesser amount of other Cu-Sn intermetallics. The metal matrix in such a case is thus composed of three individual phases which form a single mechanically interconnecting or continuous matrix. A preferred embodiment of the invention employs resin bond type copper clad diamond, with a mixture of copper and tin powders as the precursor of the metal matrix. In this preferred embodiment, a portion of the elemental tin reacts with the copper cladding of the diamond to make the cladding a mechanically continuous part of the metal matrix of the bonding matrix. In cases where borazon (cubic boron nitride) is employed as the abrasive, in coated form, a nickel coated abrasive grain is preferred.

The resin phase of the matrix may be any bonding resin which is infusible in its final form. Thus the precursor for the resin phase of the bond may be a thermosetting pre-polymer such as a "B" stage phenolic powder, or may be a coalescible powder of an infusible polymer such as a polyimide as taught in U.S. Pat. No 3,523,773. By infusible, we mean a resin which does not melt upon heating to 250° C. This term thus includes thermosetting resins and high temperature essentially noncross-linked polymers such as the polyimides and polyphenylene sulfides, which can be molded by application of heat and pressure the resin in a powdered form.

The bond of this invention may also include conventional finely divided particulate fillers heretofore employed in grinding wheels such as aluminum oxide, silicon carbide, and boron carbide as abrasive fillers, $MoS_2$, polytetrafluoroethylene, graphite, hexagonal boron nitride, as lubricating fillers, and metal fillers that do not melt or coalesce to become part of the continuous metal matrix. Among these fillers, silicon carbide and graphite are preferred.

The operative ratio of metal to resin, by volume, for improved results against a standard commercial phenolic bonded diamond wheel of the same diamond content, is from 5/95 to 95/5, the preferred range is from 15/85 to 85/15, and the optimum range is from 55/45 to 75/25. The abrasive content can be as high as 65 volume percent, the preferred range is from 5 to 50% by volume, the optimum is from 10 to 30% by volume.

The metal powder, for forming the metal matrix of the bond, may contain from 10 to 80%, by weight of the low melting metal, preferably from 30 to 50% by weight, of the metal powders.

It is conventional in the art of making premium abrasive grinding wheels to fabricate wheels in which only the outer rim is fabricated with included premium abrasive grains. The core of the wheel to which the abrasive rim is attached can be prepared of the same or similar composition, exclusive of the premium abrasive (diamond or cubic boron nitride), as the abrasive rim, so as to match thermal expansion with, and enhance adhesion to, the grinding section. Silicon carbide may be substituted for diamond or boron nitride in the core material. For thin wheels (less than 3/32 inch or 2.5 mm) steel cores are preferred. Thick wheels (over ¼ inch) may be cemented to filled phenolic cores.

When the work to be ground are tools of high speed steels or tool steels, cubic boron nitride abrasive is employed instead of diamond. In such cases, the preferred abrasive is cuibic boron nitride having a nickel coating. For grinding T15 steel, phenol-formaldehyde resin is preferred over a polyimide, while for grinding 52100 steel, an infusible polyimide is preferred.

Whether diamond or boron nitride is the abrasive, the particular field of use of the wheels of this invention is in the shaping and sharpening by wet grinding of tools such as drills, rotating burrs and indexable inserts.

EXAMPLE OF PREFERRED EMBODIMENTS

Metal powder, resin powder and diamond of the following kinds and amounts were homogeneously mixed:

| | Wt. (gm) | Vol. % |
|---|---|---|
| Toray KC 5000 polyimide resin powder available from Toray Industries Inc., Tokyo, Japan | 1.65 | 18.4 |
| Copper Powder | 16.81 | 27.4 |
| Tin Powder | 13.81 | 27.4 |
| Diamond, 140/170 mesh, copper clad, resin bond type | 4.54 | 18.7 |
| Copper (as Coat on diamond) | 4.54 | 8.1 |

The mixture was placed in a ring mold and molded at 5 tons per square inch to a temperature of 350° C (20 minutes to heat to 350°, then cooled to 100° C and removed from mold). The ring was cemented to an aluminum filled phenolic resin core with epoxy cement to produce a 5 inch diameter, 3/16 inch thick grinding wheel with a 1 inch center hole. Grinding tests against a standard commercial phenolic bonded wheel, containing silicon carbide filler, and the same amount of diamond as the test wheel, showed an increase of better than 100% and up to 298% in efficiency in wet grinding cemented tungsten carbide. The test employed a surface grinder to grind a 22.64 square inch surface of Kennametal K3H cemented tungsten carbide; the conditions were:

Wheel speed: 4100–5300 surface feet per minute
Table traverse: 50 feet per minute
Unit cross-feed: 50 mils (.050 inches) per pass
Downfeed: 1 mil per pass for a total of 30 passes
Coolant: Standard commercial coolant diluted 40 to 1 with water (Norton Wheelmate 203)

In this application when reference is made to "abrasive boron nitride" we mean to refer to boron nitride in one of the crystal forms in which it is harder than aluminum oxide. One such form is cubic boron nitride, the other is the hexagonal (wurtzite structure) form. The other hexagonal form, analagous to graphite, is soft and not considered to be an abrasive.

What is claimed is:

1. A method of making grinding wheels containing premium abrasives selected from the group consisting of diamond and abrasive boron nitride having a bond matrix consisting of two interlocked continuous phases, one of metal and one of an organic polymer which remains solid at 250° C and below, said metal matrix consisting of a least two metals at least one selected from the group consisting of tin, bismuth, and indium and at least one selected from the group consisting of iron, cobalt, tantalum, manganese, nickel, titanium, silver, and copper and including a phase melting above 250° C, comprising mixing powdered metal, including at least one metal melting below the temperature stability limit of the resin, with abrasive grits, and with an organic resin or resin precursor in powdered form, subjecting such mixture to heat and pressure in a mold such that the metal and resin individually coalesce to form continuous separate interlocked phases throughout which the abrasive particles are uniformly distributed.

2. A method as in claim 1 in which the resin employed is a polyimide powder.

3. A method as in claim 1 in which the volume ratio of resin to metal is 90/10 to 30/70.

4. A method as in claim 3 in which the abrasive grits are present in an amount of from 10 to 30 volume percent of the total bond plus abrasive volume, the resin is selected from the group consisting of phenol-formaldehyde and polyimide resins, the metal powders are copper and tin in a weight ratio of copper to tin of from 50/50 to 70/30, and the abrasive is copper clad diamond.

5. A method as in claim 3 in which the abrasive is nickel clad cubic boron nitride and the bond is phenol-formaldehyde resin.

6. A method as in claim 3 in which the premium abrasive containing matrix is mounted on a core of the same composition except that silicon carbide is substituted for the diamond.

* * * * *